US006440630B2

(12) United States Patent
Isobe et al.

(10) Patent No.: US 6,440,630 B2
(45) Date of Patent: Aug. 27, 2002

(54) TONER AND IMAGE FORMING METHOD

(75) Inventors: Kazuya Isobe; Yoshiaki Kobayashi; Yoshiki Nishimori; Meizo Shirose; Hiroshi Yamazaki, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/808,296

(22) Filed: Mar. 14, 2001

(30) Foreign Application Priority Data

Mar. 16, 2000 (JP) ..... 2000-074148

(51) Int. Cl.[7] ..... G03G 13/20

(52) U.S. Cl. ..... 430/124; 430/137.1; 430/137.14; 399/331; 399/333

(58) Field of Search ..... 430/124, 137.1, 430/137.14; 399/331, 333

(56) References Cited

U.S. PATENT DOCUMENTS 5,589,313 A * 12/1996 Takezawa et al. ..... 430/122

* cited by examiner

*Primary Examiner*—Mark Chapman
(74) *Attorney, Agent, or Firm*—Bierman, Muserlian and Lucas

(57) ABSTRACT

A toner image forming method by developing an electrostatic latent image on a photoreceptor to form a toner image employing a developer comprising toner, transferring the toner image onto an image forming material, and fixing the transferred toner image employing a fixing unit, is disclosed.

The fixing unit is comprised of a heating roller and a pressure roller which is brought into contact with said heating roller, the heating roller is constituted of a cylinder having an interior diameter of from 10 to 70 mm and a wall thickness of from 0.1 to 2 mm comprised of a metal or a metal alloy, and a heating member being incorporated in the interior, a surface of the cylinder being covered with a fluorine resin at a thickness of from 10 to 500 $\mu$m, the pressure roller is constituted of a metal cylinder whose surface is covered with an elastic material having an Asker hardness C of less than 80 degrees at a thickness of 0.1 30 mm, and the toner is comprised of a binder resin, a colorant, and a releasing agent, and is obtained by salting out/fusing resin particles comprising releasing agents in binding resins and colorant particles.

18 Claims, 3 Drawing Sheets

TONER AND IMAGE FORMING METHOD

FIELD OF THE INVENTION

The present invention relates to a toner and an image forming method.

BACKGROUND OF THE INVENTION

When toner images are fixed utilizing a heated roll fixing system, heretofore, it has been known that as a means to minimize the generation of offset phenomena, silicone oil is applied to the surface of said heating roller in a fixing unit so that said heating roller is treated for releasability for toners. Such a method is advantageous, since types of used toners are not limited.

In such a method, however, the silicone oil, which is applied to the surface of the heating roller for an extended period of time, is modified (or gelled) to result in offsetting due to a decrease in releasability provided with said roll, and during image formation, image staining occurs. As a result, the working life of the fixing unit is shorter compared to one to which silicone oil is not applied.

Further, there is another problem in which volatile components in the silicone oil, volatilize due to heat on the surface of the heating roller, and adhere to and stain the optical system, charging electrodes, and the like, resulting in image problems.

From the viewpoint of the foregoing, it has been demanded that no silicone oil be applied to a fixing unit (specifically, a heating roller), or only a very small amount of silicone oil be applied to the fixing unit.

In order to respond to such a demand, it has been common practice for a toner itself to be provided with releasability by adding releasing agents to said toner.

In such cases, in order to allow a toner to exhibit, to the greatest extent, the effects of the addition of releasing agents, it is required that said releasing agent in said toner exists in a domain state. In order to realize said state, generally, said releasing agents are not compatible with binder resins constituting said toner.

Conventionally, a toner, comprised of binder resins, colorants, and releasing agents, is produced employing a method (hereinafter referred to as a "kneading and pulverization method") in which said binder resins, said colorants, and said releasing agents are melt kneaded, and then pulverized, and if desired, classified.

In said kneading and pulverization method, a toner is prepared by dispersing releasing agents, which are insoluble in the binder resins, into said binders, and subsequently pulverizing the resultant dispersion. As a result, the resultant toner particles tend to result in non-uniformity and fluctuation of the dispersed state of releasing agents (in terms of the dispersed region, as well as the dispersed amount) and of the surface state.

When a toner, comprised of said non-uniform particles, is employed in image formation over an extended period of time, tiny offset-resulting components are adhered to the heating roller, and accumulate onto the surface of said heating roller and/or the pressure roller to result in image problems.

Such problems tend to occur due to effects of the generation of offsetting on the high temperature side heated by excessive fixing heat during high speed fixing, and by accumulated heat at the edges of the roller during switching of transfer sheets from a small size to a large size.

SUMMARY OF THE INVENTION

From the view of the foregoing, the present invention has been achieved.

An object of the present invention is to provide a toner which is employed in an image forming method comprising a process for forming fixed images, employing a fixing unit to which no silicone oil is applied, or only a very small amount of silicone oil is applied, and is capable of forming excellent images without resulting in image staining as well as image problems for an extended period of time, and further is capable of extending the working life of said fixing unit.

The invention and its preferable embodiment are described.

An image forming method comprising developing an electrostatic latent image formed on a photoreceptor to form a toner image employing a developer comprising a toner, transferring the toner image onto an image forming material, and fixing the transferred toner image employing a fixing unit, wherein

- the fixing unit comprises a heating roller and a pressure roller which is brought into contact with said heating roller,
- the heating roller comprises a cylinder having an interior diameter of from 10 to 70 mm and a wall thickness of from 0.1 to 2 mm comprised of a metal or a metal alloy, and a heating member being incorporated in the interior, a surface of the cylinder being covered with a layer comprising a fluorine resin at a thickness of from 10 to 500 $\mu$m,
- the pressure roller comprises a metal cylinder covered with a covering layer comprising an elastic material having an Asker hardness C of less than 80 degrees at a thickness of 0.1 to 30 mm, and
- the toner comprises at least of a binder resin, a colorant, and a releasing agent, and is obtained by salting out/fusing resin particles comprising the releasing agent in binding resin and colorant particles.

The preferable fluorine resin is polytetrafluoroethylene or tertafluoroethylene-perfluoroalkyl vinyl ether copolymer.

The cylinder of the heating roller is preferably composed of iron, aluminum, copper, or alloy thereof.

The elastic material is soft rubber or foamed rubber, and more preferably urethane rubber, silicone rubber, or silicone sponge rubber.

The most preferably example of the elastic material is silicone rubber, or silicone sponge rubber.

The Asker C hardness of elastic material is preferably less than 70 degrees.

The Asker C hardness of elastic material is preferably less than 60 degrees.

In the image forming method the preferable example of the releasing agent is represented by Formula (1), $$R^1\text{—}(OCO\text{—}R^2)_n \qquad (1)$$

wherein $R^1$ and $R^2$ each represent a hydrocarbon group having from 1 to 40 carbon atoms which may have a substituent, and n represents an integer of 1 to 4.

In the image forming method silicone oil is supplied to the heating roller in amount of, preferably, not more than 2 mg per A4 sized sheet of paper.

The thickness of the layer comprising the fluorine resin is preferably 20 to 400 $\mu$m.

The thickness of the covering layer is preferably 0.1 to 20 $\mu$m.

The temperature of fixing is preferably 150 to 210° C.

The content ratio of releasing agents in the toner is preferably 1 to 30 percent by weight.

The toner has an average value preferably of the shape coefficient of 0.930 to 0.980.

The toner of the present invention is employed in an image forming method which comprises processes in which an electrostatic latent image, formed on a photoreceptor, is developed employing a developer comprising said toner, subsequently the formed toner image is transferred onto a support, and the transferred toner image is then fixed employing a fixing unit. Said fixing unit is comprised of a heating roller and a pressure roller which is brought into contact with said heating roller. Said heating roller is constituted in such a manner that the surface of a cylinder having an interior diameter of 10 to 70 mm and a wall thickness of 0.1 to 2 mm, comprised of a metal or a metal alloy, is covered with fluorine resins at a thickness of 10 to 500 $\mu$m and a heating member is incorporated in the interior. Said pressure roller is constituted in such a manner that the surface of a metal cylinder is covered with an elastic material having an Asker hardness C of less than 80 degrees at a thickness of 0.1 to 30 mm. Said toner is comprised at least of a binder resin, a colorant, and a releasing agent, and is obtained by salting out/fusing resin particles comprising releasing agents in binding resins and colorant particles.

When the toner of the present invention is employed, the supply amount of silicone oil to said heating roller comprised of said fixing unit is preferably not more than 2 mg/A4 sized sheet of paper.

DETAILED DESCRIPTION OF THE INVENTION

Figure 1:
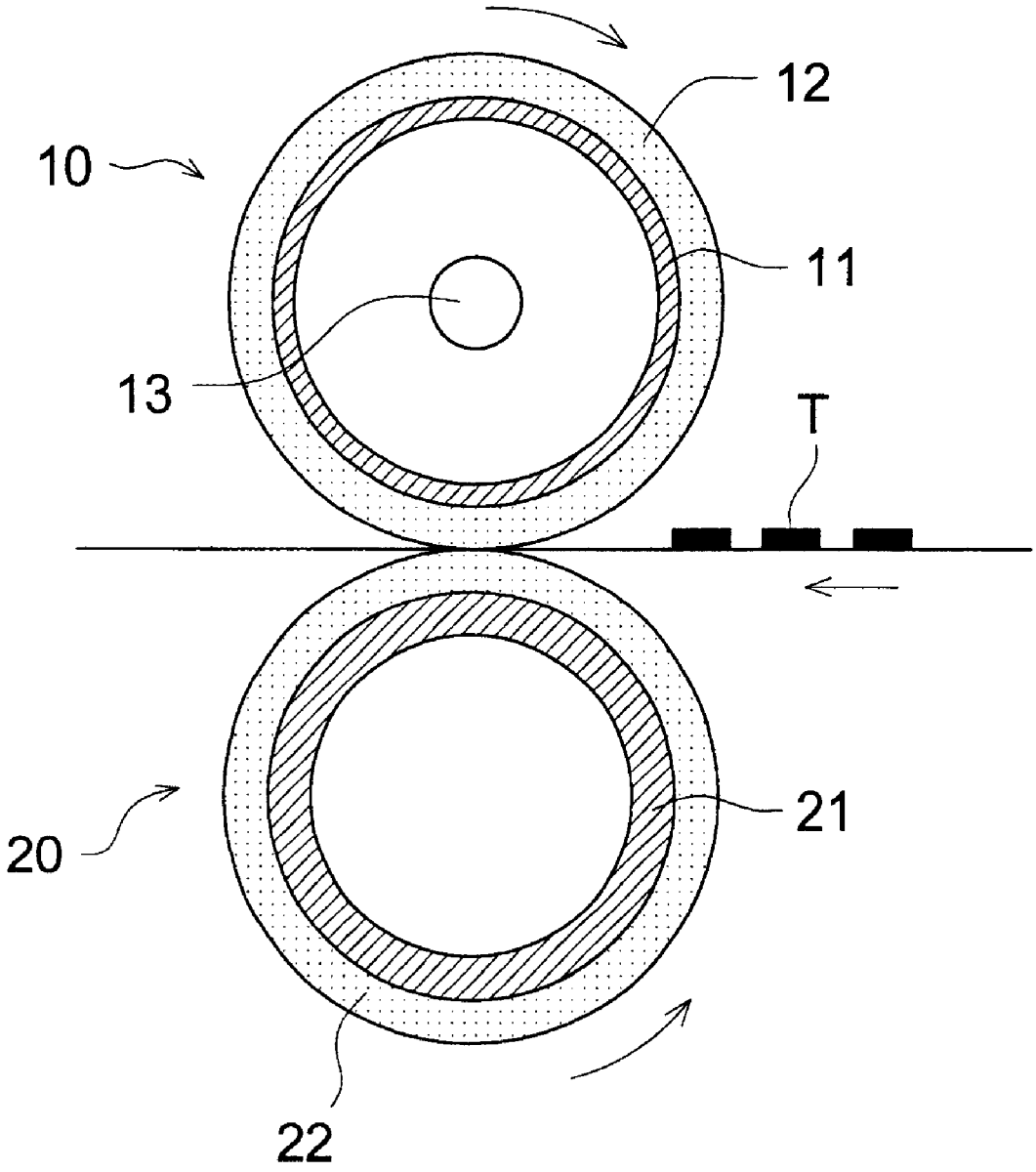
FIG. 1 is a cross-sectional view showing an example of a fixing unit employed in the present invention.

"Salting-out/fusion", as described in the present invention, refers to an operation in which salting-out (aggregation of particles) and fusion (disappearance of the interface between particles) occur simultaneously, or salting-out and fusion are allowed to occur simultaneously. In order to simultaneously carry out salting-out and fusion, particles (resinous particles and colorant particles) are aggregated at a temperature which is equal to or higher than the glass transition temperature (Tg) of the resin constituting said particles. The term "simultaneously" means that salting-out process and fusion process go on at same time. Each process is not necessary to start or end at the same time.

The inventors of the present invention have investigated the composition of a toner which is required to effectively minimize offset phenomena during fixing. As a result, it was discovered that it was possible to effectively minimize offset phenomena by employing a coalesced type toner which was obtained by salting out/fusing resinous particles comprising releasing agents, together with colorant particles in a water based medium. Further, it was discovered that wide-ranged fixability was obtained, and adhesive properties between toner particles were improved. Furthermore, by constituting toner particles by salting out/fusing resinous particles comprising releasing agents along with colorant particles in a water based medium, it was possible to decrease fluctuation of the dispersed state of said releasing agents as well as the surface state between toner particles. As a result, it has become possible to retard accumulation of the toner during an extended period of time, which results in offsetting.

Though the toner of the present invention comprises releasing agents which are not compatible with binding resins, it is possible to allow the dispersed state of said releasing agents to be uniform among toner particles. As a result, it is possible to minimize the fluctuation of offsetting resistance, as well as to minimize fixability among toner particles, and it is therefore possible to accomplish the object of the present invention.

It has been discovered that by employing a toner which is obtained by salting out/fusing resinous particles comprising releasing agents and colorant particles, it is possible to place said releasing agents in said toner particles so as to form a fine domain structure, and it is also possible to minimize the fluctuation of the releasing agent dispersed state (in terms of dispersed region and dispersed amount) as well as the surface state. As a result, it is possible to minimize the differences in releasability as well as fixability between toner particles. Subsequently, even though said toner is employed to form images for an extended period of time, it is possible to minimize the generation of minute offsetting, and thus it is possible to minimize surface staining on the heating roller as well as on the pressure roller.

Further, by employing, as a heating roller which is comprised in a fixing unit, a roller (a hard roller) prepared by covering a metal cylinder surface with fluorine resin having a thickness of 10 to 500 $\mu$m, and as a pressure roller, a roller (a soft roller) prepared by covering a metal cylinder surface with an elastic material having an Asker C harness of less than 80 degrees at a thickness of 0.1 to 30 mm, it is possible to obtain excellent fixability due to the broad nip width formed by these rollers and to increase the durability of said fixing unit itself.

However, under the combination of said heating roller with said pressure roller, said pressure roller (a soft roller) is deformed to form a concave nip state. As a result, the peeling angle at the fix peeling section becomes greater so that offset phenomena tend to occur.

In order to overcome said drawback, in the present invention, a specified coalesced toner (the toner of the present invention) is utilized so that the dispersed state of releasing agents in said toner particles becomes uniform and as a result, it is possible to improve the fixability while minimizing the generation of offsetting, even when a fixing device which exhibits great peeling angle is employed.

Asker C hardness is determined in accordance with JIS K6253-1997 or IS07619, and is measured on a rubber sample having thickness of 12 mm by employing Type A durometer.

Effects (1) Since the toner of the present invention is a coalesced type toner prepared by a salting-out/fusion method, the fluctuation of the surface state (the surface composition) among toner particles is minimized. As a result, excellent fixability is exhibited and said fixability results in no fluctuation among toner particles.

(2) Since the toner of the present invention is obtained by coalescing resinous particles comprising releasing agents employing a salting-out/fusion method, the dispersed state of said releasing agents becomes markedly uniform. As a result, excellent offsetting resistance is exhibited and said offsetting resistance does not fluctuate among toner particles.

The present invention will now be detailed.

<Fixing Unit>

The toner of the present invention is employed in an image forming method (the image forming method of the present invention) comprising a fixing process employing a specified fixing unit.

FIG. 1 is a cross-sectional view showing an example of a fixing unit employed in the present invention. The fixing unit shown in FIG. 1 comprises heating roller 10 and pressure roller 20 which is brought into contact with said heating roller 10. Further, in FIG. 1, T is a toner image formed on a sheet of transfer paper (an image forming support).

Heating roller 10 comprises cylinder 11 having thereon covering layer 12 comprised of fluorine resins and includes heating member 13 comprised of a linear heater. due to paper dust. Then, a toner adheres to said abrasion to result in problems with image staining.

Halogen heaters may be suitably employed as heating member 13.

Pressure roller 20 comprises cylinder 21 having on its surface covering layer 22 comprised of elastic materials. Elastic materials constituting covering layer 22 are not particularly limited, and may include various types of soft rubber such as urethane rubber, silicone rubber, and the like, and also foamed rubber. Silicone rubber as well as silicone sponge rubber is preferably employed, which is exemplified as those constituting covering layer 12.

The Asker C hardness of elastic materials, constituting covering layer 22, is commonly less than 80 degrees, is preferably less than 70 degrees, and is more preferably less than 60 degrees.

Further, the thickness of covering layer 22 is commonly 0.1 to 30 mm, and is preferably 0.1 to 20 mm.

When the Asker C hardness of elastic materials constituting covering layer 22 exceeds 80 degrees, as well as when the thickness of the covering layer is less than 0.1 mm, it is impossible to increase the fixing nip. Accordingly it is impossible to exhibit effects of soft fixing.

Said cylinder 11 is comprised of metal and its interior diameter is 10 to 70 mm. Metals which constitute cylinder 11 are not particularly limited, and include, for example, metals such as iron, aluminum, copper, and the like, and alloys thereof.

The wall thickness of cylinder 11 is 0.1 to 2 mm, and is determined while taking into account the balance between the demand of energy saving (by a decrease in thickness) and strength (dependent on the composition materials). For example, the some strength resulting from an iron cylinder having a wall thickness of 0.57 mm is obtained by an aluminum cylinder having a wall thickness of 0.8 mm.

Exemplified as fluorine resins constituting covering layer 12 may be PTFE (polytetrafluoroethylene), PFA (tertafluoroethylene-perfluoroalkyl vinyl ether copolymers), and the like.

The thickness of covering layer 12 is commonly 10 to 500 $\mu$m, and is preferably 20 to 400 $\mu$m.

When the thickness of covering layer 12 is less than 10 $\mu$m, it is impossible to allow said covering layer 12 to sufficiently exhibit the function as the covering layer, and also it is impossible to obtain the durability as a fixing unit. On the other hand, the surface of the covering layer having a thickness of no less than 500 $\mu$m tends to be abraded possible to employ a method in which cleaning is carried out by supplying silicone oil employing a silicone oil impregnated pad, a roller, a web, and the like.

However, the effects of the present invention are markedly exhibited when an image forming process is included by employing a fixing unit in which no silicone oil is supplied, or when only a very small amount of silicone oil is supplied. Accordingly, even when silicone oil is supplied, the supply amount is preferably not more than 2 mg per A4 sized sheet of paper.

By regulating the supply amount of silicone oil to not more than 2 mg per A4 sized sheet of paper, the adhesion amount of silicone oil to a transfer sheet (an image forming support), after fixing, decreases. As a result, adhered silicone oil does not hinder writing on the transfer sheet using writing materials comprising oil based ink such as a ballpoint pen and the like, and thus writability, in general, is not degraded.

Further, it is possible to minimize a decrease in offsetting resistance due to modified silicone oil during an extended use, and also to minimize problems such as staining the optical system and charge electrodes, and the like.

The supply amount of the silicone oil is calculated as follows: 100 transfer sheets (A4 sized sheets without images)

Materials constituting cylinder 21 are not particularly limited, and may include metals such as aluminum, iron, copper, and the like, and alloys thereof.

The contact load (total load) of heating roller 10 applied to pressure roller 20 is commonly 40 to 350 N, is preferably 50 to 300 N, and is more preferably 50 to 250 N. Said load is set taking into the strength (the wall thickness of cylinder 11) of heating roller 10. For example, when a heating roller comprised of an iron cylinder having a wall thickness of 0.3 mm is employed, the applied load is preferably not more than 250 N.

Further, from the viewpoint of offsetting resistance as well as fixability, nip width is preferably 4 to 10 mm, and the surface pressure of said nip is preferably $0.6\times10^5$ to $1.5\times10^5$ Pa.

When the fixing unit shown in FIG. 1 is employed, an example of fixing conditions are as follows: fixing temperature (surface temperature of heating roller 10) is 150 to 210° C., and fixing linear speed is 80 to 640 mm/second.

If desired, the fixing unit employed in the present invention may have a cleaning mechanism. In this case, when a method is employed in which silicone oil is supplied to the upper roller (a heating roller) in the fixing section, it is are continually passed through a heated fixing unit, the weight difference ($\Delta w$) of the fixing unit before and after passing said sheets is determined, and $\Delta w/100$ is then calculated.

<Image Forming Method and Image Forming Apparatus>

Figure 2:
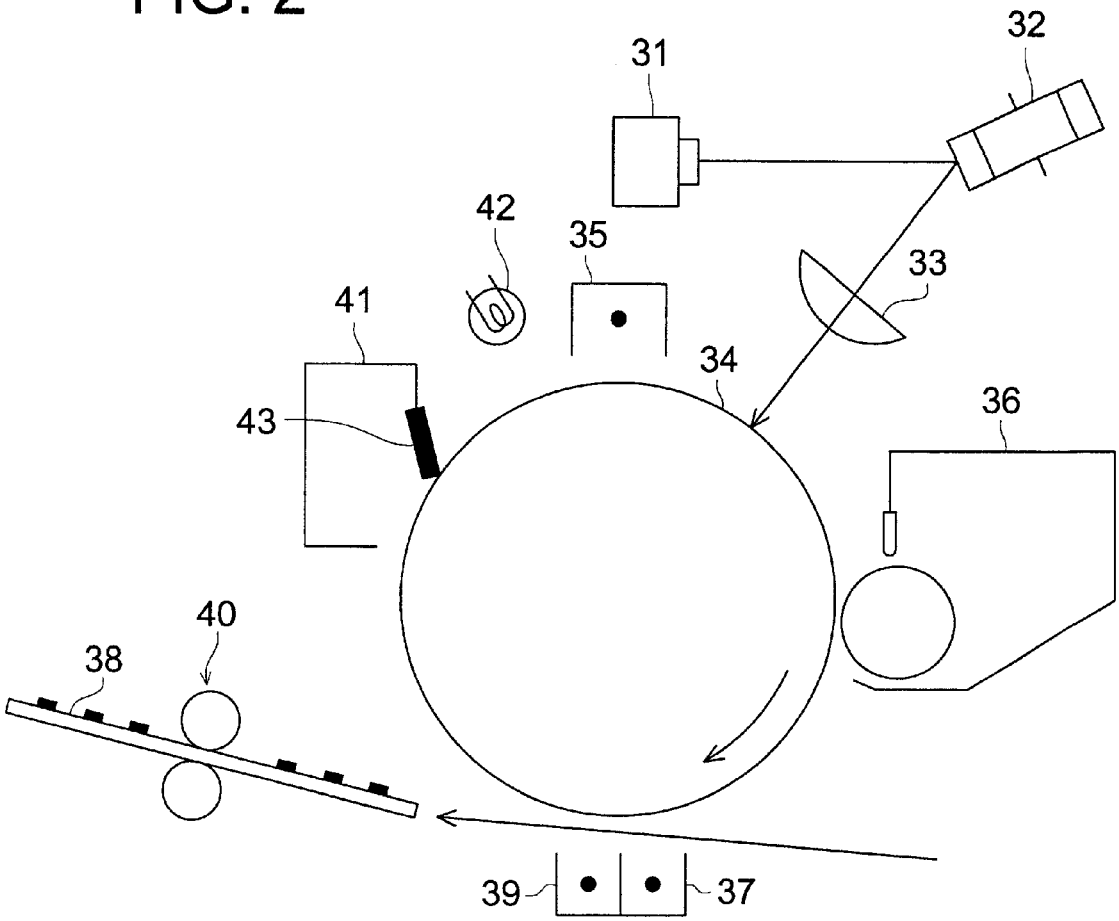
FIG. 2 is a schematic view of an image forming apparatus for use in the image forming method of the present invention.

FIG. 2 is a schematic view of an image forming apparatus for use in the image forming method of the present invention. In FIG. 2, numeral 34 is a photoreceptor which is the representative example of an electrostatic latent image forming body. Said photoreceptor 34 is constituted by forming an organic photoconductor utilized as a photoreceptor layer on the external circumferential surface of an aluminum drum base body, and rotates in the arrowed direction at the specified speed. In the present embodiment, the external diameter of said photoreceptor 34 is 60 mm.

In the image forming apparatus shown in FIG. 2, based on image information read by an original document reading unit (not shown), exposure light is emitted from semiconductor laser source 31. Said emitted light is allowed to move in the vertical direction against the plane of FIG. 2, employing polygonal mirror 32, and irradiated onto the surface of photoreceptor 34 via fθ lens 33 which compensates image distortion so that an electrostatic latent image is formed. Photoreceptor 34, which has been uniformly charged by charging unit 35, commences clockwise rotation in synchronization with image exposure timing.

The electrostatic latent image on the surface of photoreceptor 34 is developed employing development unit 36, and the formed toner image is transferred through the action of transfer unit 37 to recording member (an image forming support) 38 which is conveyed so as to match said timing. Subsequently, recording member 38 is separated from photoreceptor 34 employing separation unit (a separation pole) 39, and said toner image is transferred to and borne by recording member 38, conveyed to fixing unit 40 (the fixing unit which is constituted as shown in FIG. 1), and fixed.

Figure 3:
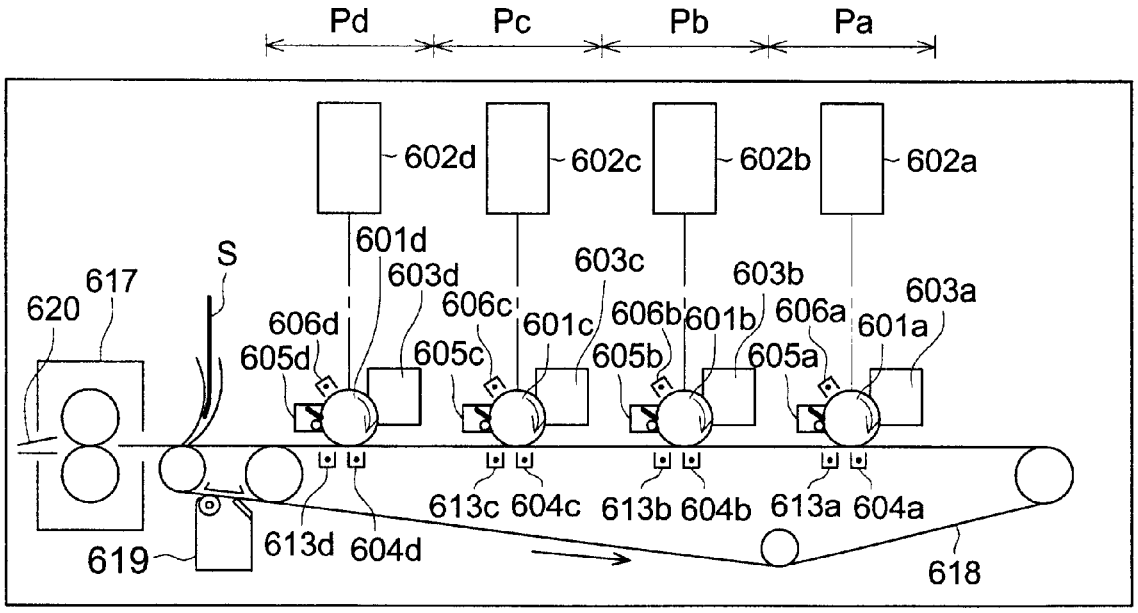
FIG. 3 is a schematic view of another image forming apparatus for use in the image forming method of the present invention.

The invention can be applied to an image forming apparatus shown in FIG. 3.

The residual toner, and the like, on the surface of photoreceptor 34, which has not been transferred, is removed employing cleaning unit 41 which utilizes a cleaning blade system. Subsequently, photoreceptor 34 is subjected to residual charge elimination employing pre-charging light exposure (PCL) 42 and is uniformly recharged employing charging unit 35.

Incidentally, said recording member is commonly plain paper. However, said recording member is not particularly limited as long as unfixed images after development are transferable. Naturally PET base recording members for overhead projection use and the like is included.

Further, cleaning blade 43 is comprised of a rubber-like elastic body having a thickness of 1 to 30 mm, and urethane rubber is most frequently employed.

<Toner>

The toner of the present invention is one which comprises binding resins, colorants, and releasing agents, and is comprised of coalesced type particles which are obtained by salting out/fusing resinous particles comprising said releasing agents in said binding resins and colorant particles.

<Releasing Agents>

Releasing agents, which constitute the toner of the present invention, are not particularly limited. However, preferred are those which are comprised of crystalline ester compounds (hereinafter referred to as "specified ester compounds") represented by General Formula (1), described below.

$$R^1\text{—}(OCO\text{—}R^2)_n \qquad \text{General Formula (1):}$$

wherein $R^1$ and $R^2$ each represent a hydrocarbon group having from 1 to 40 carbon atoms which may have a substituent, and n represents an integer of 1 to 4.

<Specified Ester Compounds>

In General Formula (1), which represents specified ester compounds, $R^1$ and $R^2$ each represent a hydrocarbon group which may have a substituent.

Said hydrocarbon group $R^1$ generally has from 1 to 40 carbon atoms, preferably has from 1 to 20 carbon atoms, and more preferably has from 2 to 5 carbon atoms.

Said hydrocarbon group $R^2$ generally has from 1 to 40 carbon atoms, preferably has from 16 to 30 carbon atoms, and more preferably has from 18 to 26 carbon atoms.

Further, in General Formula (1), n is generally an integer of 1 to 4, is preferably an integer of 2 to 4, is more preferably an integer of 3 and 4, and is most preferably the integer of 4.

It is possible to suitably synthesize said specified ester compounds employing dehydration condensation reaction between alcohols and carboxylic acids.

Listed as specific examples of specified ester compounds may be those represented by formulas 1) through 22) shown below.

1) $CH_3\text{—}(CH_2)_{12}\text{—}COO\text{—}(CH_2)_{17}\text{—}CH_3$

2) $CH_3\text{—}(CH_2)_{18}\text{—}COO\text{—}(CH_2)_{17}\text{—}CH_3$

3) $CH_3\text{—}(CH_2)_{20}\text{—}COO\text{—}(CH_2)_{21}\text{—}CH_3$

4) $CH_3\text{—}(CH_2)_{14}\text{—}COO\text{—}(CH_2)_{19}\text{—}CH_3$

5) $CH_3\text{—}(CH_2)_{20}\text{—}COO\text{—}(CH_2)_6\text{—}O\text{—}CO\text{—}(CH_2)_{20}\text{—}CH_3$ 6) $CH_3\text{—}(CH_2)_{20}\text{—}COO\text{—}(CH_2)_2\text{—}CH(CH_3)\text{—}CH_2\text{—}O\text{—}CO\text{—}(CH_2)_{20}\text{—}CH_3$ 7) $CH_3\text{—}(CH_2)_{22}\text{—}COO\text{—}(CH_2)_2\text{—}CH(CH_3)\text{—}CH_2\text{—}O\text{—}CO\text{—}(CH_2)_{22}\text{—}CH_3$ 8) $CH_3\text{—}(CH_2)_{22}\text{—}COO\text{—}CH_2\text{—}C(CH_3)_2\text{—}CH_2\text{—}O\text{—}CO\text{—}(CH_2)_{22}\text{—}CH_3$ 9) $CH_3\text{—}(CH_2)_{26}\text{—}COO\text{—}CH_2\text{—}C(CH_3)_2\text{—}CH_2\text{—}O\text{—}CO\text{—}(CH_2)_{26}\text{—}CH_3$ 10) $CH_2\text{—}O\text{—}CO\text{—}(CH_2)_{26}\text{—}CH_3$
$CH\text{—}O\text{—}CO\text{—}(CH_2)_{26}\text{—}CH_3$
$CH_2\text{—}O\text{—}CO\text{—}(CH_2)_{26}\text{—}CH_3$ 11) $CH_2\text{—}O\text{—}CO\text{—}(CH_2)_{22}\text{—}CH_3$
$CH\text{—}O\text{—}CO\text{—}(CH_2)_{22}\text{—}CH_3$
$CH_2\text{—}O\text{—}CO\text{—}(CH_2)_{22}\text{—}CH_3$ -continued

12) $CH_2-OH$
$CH-O-CO-(CH_2)_{26}-CH_3$
$CH_2-O-CO-(CH_2)_{26}-CH_3$

13) $CH_2-OH$
$CH-O-CO-(CH_2)_{22}-CH_3$
$CH_2-O-CO-(CH_2)_{22}-CH_3$

14) $CH_2-OH$
$CH-OH$
$CH_2-O-CO-(CH_2)_{26}-CH_3$

15) $CH_2-OH$
$CH-OH$
$CH_2-O-CO-(CH_2)_{22}-CH_3$

16) $CH_3-(CH_2)_{26}-COO-CH_2-C(CH_3)(CH_2-O-CO-(CH_2)_{26}-CH_3)(CH_2-O-CO-(CH_2)_{26}-CH_3)$

17) $CH_3-(CH_2)_{20}-COO-CH_2-C(CH_2CH_3)(CH_2-O-CO-(CH_2)_{20}-CH_3)(CH_2-O-CO-(CH_2)_{20}-CH_3)$

18) $CH_3-(CH_2)_{26}-COO-CH_2-C(CH_2-O-CO-(CH_2)_{26}-CH_3)(CH_2-O-CO-(CH_2)_{26}-CH_3)(CH_2-O-CO-(CH_2)_{26}-CH_3)$

19) $CH_3-(CH_2)_{20}-COO-CH_2-C(CH_2-O-CO-(CH_2)_{20}-CH_3)(CH_2-O-CO-(CH_2)_{20}-CH_3)(CH_2-O-CO-(CH_2)_{20}-CH_3)$

20) $CH_3-(CH_2)_{18}-COO-CH_2-C(CH_2-O-CO-(CH_2)_{18}-CH_3)(CH_2-O-CO-(CH_2)_{18}-CH_3)(CH_2-O-CO-(CH_2)_{18}-CH_3)$

21) $CH_3-(CH_2)_{16}-COO-CH_2-C(CH_2-O-CO-(CH_2)_{16}-CH_3)(CH_2-O-CO-(CH_2)_{16}-CH_3)(CH_2-O-CO-(CH_2)_{16}-CH_3)$

22) $CH_3-(CH_2)_{20}-COO-CH_2-C(CH_2-O-CO-CH_3)(CH_2-O-CO-CH_3)(CH_2-O-CO-CH_3)$

<Content Ratio of Releasing Agents>

The content ratio of releasing agents in the toner of the present invention is commonly 1 to 30 percent by weight, is preferably 2 to 20 percent by weight, and is more preferably 3 to 15 percent by weight.

<Resinous Particles Comprising Releasing Agents>

The "resinous particles containing releasing agents", as described in the present invention, may be obtained as latex particles by dissolving releasing agents in monomers to obtain binding resins, then dispersing the resulting monomer solution into a water based medium, and subsequently polymerizing the resulting dispersion.

The weight average particle diameter of said resinous particles is preferably 50 to 2,000 nm.

Listed as polymerization method employed to obtain resinous particles, in which binding resins comprise releasing agents, may be granulation polymerization methods such as an emulsion polymerization method, a suspension polymerization method, a seed polymerization method, and the like.

The following method (hereinafter referred to as an "mini-emulsion method") may be cited as a preferable polymerization method to obtain resinous particles comprising releasing agents. A monomer solution, which is prepared by dissolving releasing agents in monomers, is dispersed into a water based medium prepared by dissolving surface active agents in water at a concentration of less than the critical micelle concentration so as to form oil droplets in water, while utilizing mechanical force. Subsequently, water-soluble polymerization initiators are added to the resulting dispersion and the resulting mixture undergoes radical polymerization. Further, instead of adding said water-soluble polymerization initiators, or along with said water-soluble polymerization initiators, oil-soluble polymerization initiators may be added to said monomer solution.

Herein, homogenizers which results in oil droplets in water dispersion, utilizing mechanical force, are not particularly limited, and may include "Clearmix" (produced by M Tech Co., Ltd.) provided with a high speed rotor, ultrasonic homogenizers, mechanical homogenizers, Manton-Gaulin homogenizers, pressure type homogenizers, and the like. Further, the diameter of dispersed particles is generally 10 to 1,000 nm, and is preferably 30 to 300 nm.

<Binding Resins>

Binding resins, which constitute the toner of the present invention, preferably comprise high molecular weight components having a peak, or a shoulder, in the region of 100,000 to 1,000,000, as well as low molecular weight components having a peak, or a shoulder, in the region of 1,000 to 20,000 in terms of the molecular weight distribution determined by GPC.

Herein, the method for measuring the molecular weight of resins, employing GPC, is as follows. Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 $\mu$m, the filtrate is injected in a GPC.

Measurement conditions of GPC are described below. A column is stabilized at 40° C., and THF is flowed at a rate of 1 cc per minute. Then measurement is carried out by injecting approximately 100 $\mu$l of said sample at a concentration of 1 mg/cc. It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK quard column, and the like. Further, as a detector, a refractive index detector (IR detector) or a UV detector is preferably employed. When the molecular weight of samples is measured, the molecular weight distribution of said sample is calculated employing a calibration curve which is prepared employing a monodispersed polystyrene as standard particles. Approximately ten polystyrenes samples are preferably employed for determining said calibration curve.

The composition materials of resinous particles and the preparation thereof will now be described.

(Monomers)

Of polymerizable monomers which are employed to prepare resinous particles, radical polymerizable monomers are essential components, and if desired, crosslinking agents may be employed. Further, at least one of said radical polymerizable monomers having an acidic group or radical polymerizable monomers having a basic group, described below, is preferably incorporated.

(1) Radical Polymerizable Monomers

Radical polymerizable monomers are not particularly limited. It is possible to employ conventional radical polymerizable monomers known in the art. Further, they may be employed in combination of two or more types so as to satisfy desired properties.

Specifically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as acrylic acid ester bases monomers and methacrylic acid ester monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

(2) Crosslinking Agents

In order to improve the desired properties of toner, added as crosslinking agents may be radical polymerizable crosslinking agents. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

(3) Radical Polymerizable Monomers having an Acidic Group or a Basic Group

Employed as radical polymerizable monomers having an acidic group or a basic group may, for example, be amine based compounds such as monomers having a carboxyl group, monomers having a sulfonic acid group, and amine based compounds such as primary, secondary, and tertiary amines, quaternary ammonium salts, and the like.

Listed as radical polymerizable monomers having an acidic group are acrylic acid, methacrylic acid, fumaric acid, maleic acid, itaconic acid, cinnamic acid, monobutyl maleate, monooctyl maleate, and the like as monomers having a carboxyl group.

Listed as monomers having sulfonic acid are styrenesulfonic acid, allylsulfosuccinic acid, octyl allylsulfosuccinate, and the like.

These may be in the form of salts of alkali metals such as sodium or potassium, or salts of alkali earth metals such as calcium and the like.

Listed as radical polymerizable monomers having a basic group are amine based compounds which include dimethyl aminoethyl acrylate, dimethyl aminoethyl methacrylate, diethyl aminoethyl acrylate, diethyl aminoethyl methacrylate, and quaternary ammonium salts of said four compounds; 3-dimethylaminophenyl acrylate, 2-hydroxy-3-methacryloxypropyltrimethylammonium salt; acrylamide, N-butylacrylamide, N,N-dibutylacrylamide, piperidylacrylamide, methacrylamide, N-butylmethacrylamide, N-octadecylacrylamide; vinylpyridine; vinylpyrrolidone; vinyl N-methylpyridinium chloride, vinyl N-ethylpyridinium chloride, N,N-diallylmethylammonium chloride, N,N-diallylethylammonium chloride; and the like.

The content ratio of radical polymerizable monomers having an acidic group or a basic group is preferably 0.1 15 percent by weight with respect to the total monomers. The content ratio of radical polymerizable crosslinking agents is preferably 0.1 to 10 percent by weight with respect to the total radical polymerizable monomers.

(Chain Transfer Agents)

For the purpose of regulating the molecular weight of resinous particles, it is possible to employ commonly used chain transfer agents.

Said chain transfer agents are not particularly limited, and for example, employed are mercaptans such as octylmercaptan, dodecylmercaptan, tert-dodecylmercaptan, and the like, carbon tetrabromide, styrene dimer, and the like.

(Polymerization Initiators)

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 80° C. is employed. However, by employing a combination of polymerization initiators such as hydrogen peroxide-reducing agent (ascorbic acid and the like), which is capable of initiating the polymerization at room temperature, it is possible to carry out polymerization at at least room temperature.

(Surface Active Agents)

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4 -diazi-bis-β-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, potassium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

<Colorants>

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

When employed as a magnetic toner, it is possible to add said magnetite. In that case, from the viewpoint of providing specified magnetic properties, said magnetite is incorporated into said toner preferably in an amount of 20 to 60 percent by weight.

Employed as said organic pigments and dyes may be those conventionally known in the art. Specific organic pigments as well as dyes are exemplified below.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

Said colorants may also be employed while subjected to surface modification. As said surface modifying agents may be those conventionally known in the art, and specifically, preferably employed may be silane coupling agents, titanium coupling agents, aluminum coupling agents, and the like.

<External Additives>

For the purpose of improving fluidity as well as chargeability, and of enhancing cleaning properties, the toner of the present invention may be employed into which so-called external additives are incorporated. Said external additives are not particularly limited, and various types of fine inorganic particles, fine organic particles, and lubricants may be employed.

Employed as fine inorganic particles may be those conventionally known in the art. Specifically, it is possible to preferably employ fine silica, titanium, and alumina particles and the like. These fine inorganic particles are preferably hydrophobic. Specifically listed as fine silica particles, for example, are commercially available R-805, R-976, R-974, R-972, R-812, and R-809, produced by Nippon Aerosil Co.; HVK-2150 and H-200, produced by Hoechst Co.; commercially available TS-720, TS-530, TS-610, H-5, and MS-5, produced by Cabot Corp; and the like.

Listed as fine titanium particles, for example, are commercially available T-805 and T-604, produced by Nippon Aerosil Co.; commercially available MT-100S, MT-100B, MT-500BS, MT-600, MT-600SS, and KA-1, produced by Teika Co.; commercially available TA-300SI, TA-500, TAF-130, TAF-510, and TAF-510T, produced by Fuji Titan Co.; commercially available IT-S, IT-OA, IT-OB, and IT-OC, produced by Idemitsu Kosan Co.; and the like.

Listed as fine alumina particles, for example, are commercially available RFY-C and C-604, produced by Nippon Aerosil Co., commercially available TTO-55, produced by Ishihara Sangyo Co., and the like.

Further, employed as fine organic particles are fine spherical organic particles having a number average primary particle diameter of 10 to 2,000 nm. Employed as such particles may be homopolymers or copolymers of styrene or methyl methacrylate.

Listed as lubricants, for example, are metal salts of higher fatty acids, such as salts of stearic acid with zinc, aluminum, copper, magnesium, calcium, and the like; salts of oleic acid with zinc, manganese, iron, copper, magnesium, and the like; salts of palmitic acid with zinc, copper, magnesium, calcium, and the like; salts of linoleic acid with zinc, calcium, and the like; and salts of ricinolic acid with zinc, calcium, and the like.

The added amount of these external agents is preferably 0.1 to 5 percent by weight with respect to the toner.

The toner of the present invention is a coalesced type toner obtained by salting out/fusing resinous particles comprising releasing agents and colorant particles in a water based medium. By salting out/fusing said resinous particles comprising releasing agents, as described above, a toner is obtained in which said releasing agents are finely depressed.

In addition, the toner of the present invention possesses an uneven surface from the production stage, and a coalesced type toner is obtained by fusing resinous particles and colorant particles. Therefore, differences in the shape as well as surface properties among toner particles are minimal. As a result, the surface properties tend to be uniform. Thus difference in fixability among toner particles tends to be minimized so that it is possible to maintain excellent fixability.

<Toner Production Process>

One example of the method for producing the toner of the present invention is as follows:

(1) a dissolution process in which releasing agents are dissolved in monomers and a monomer solution is prepared (2) a dispersion process in which the resulting monomer solution is dispersed into a water based medium (3) a polymerization process in which the resulting water based dispersion of said monomer solution undergoes polymerization so that a dispersion (latex) of resinous particles comprising said releasing agents is prepared (4) a salting-out/fusion process in which the resulting resinous particles and said colorant particles are subjected to salting-out/fusion in a water based medium so as to obtain coalesced particles (toner particles)

(5) a filtration and washing process in which the resulting coalesced particles are collected from the water based medium employing filtration, and surface active agents and the like are removed from said coalesced particles (6) a drying process in which washed coalesced particles are dried, and (7) an external addition process may be included in which external agents are added to the dried coalesced particles.

(Dissolution Process)

Methods for dissolving releasing agents in monomers are not particularly limited.

The dissolved amount of said releasing agents in said monomers is determined as follows: the content ratio of releasing agents is generally 1 to 30 percent by weight with respect of the finished toner, is preferably 2 to 20 percent by weight, and is more preferably 3 to 15 percent by weight.

Further, oil-soluble polymerization initiators as well as other oil-soluble components may be incorporated into said monomer solution.

(Dispersion Process)

Methods for dispersing said monomer solution into a water based medium are not particularly limited. However, methods are preferred in which dispersion is carried out employing mechanical force. Said monomer solution is preferably subjected to oil droplet dispersion (essentially an embodiment in a mini-emulsion method), employing mechanical force, especially into a water based medium prepared by dissolving a surface active agent at a concentration of lower than its critical micelle concentration.

Herein, homogenizers to conduct oil droplet dispersion, employing mechanical forces, are not particularly limited, and include, for example, "Clearmix", ultrasonic homogenizers, mechanical homogenizers, and Manton-Gaulin homogenizers and pressure type homogenizers. Further, the diameter of dispersed particles is 10 to 1,000 nm, and is preferably 30 to 300 nm.

(Polymerization Process)

In the polymerization process, polymerization methods (granulation polymerization methods such as an emulsion polymerization method, a suspension polymerization method, and a seed polymerization method), which are conventionally known in the art, may be employed.

Listed as one example of the preferred polymerization method may be a mini-emulsion method, namely in which radical polymerization is carried out by adding water-soluble polymerization initiators to a dispersion obtained by oil droplet dispersing a monomer solution, employing mechanical force, into a water based medium prepared by dissolving a surface active agent at a concentration lower than its critical micelle concentration.

(Salting-Out/Fusion Process)

In the salting-out/fusion process, a colorant particle dispersion is added to a dispersion comprised of resinous particles obtained by said polymerization process so that said resinous particles and said colorant particles are subjected to salting-out/fusion in a water based medium.

Further, in said salting-out/fusion process, resinous particles as well as colorant particles may be fused with internal agent particles and the like.

"Water based medium", as described in said salting-out/fusion process, refers to one in which water is a main component (at least 50 percent by weight). Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

It is possible to prepare colorant particles employed in said salting-out/fusion process by dispersing colorants into a water based medium. Dispersion of colorants is carried out in such a state that the concentration of surface active agents in water is adjusted to at least critical micelle concentration.

Homogenizers to disperse colorants are not particularly limited, and preferably listed are "Clearmix", ultrasonic homogenizers, mechanical homogenizers, Manton-Gaulin and pressure type homogenizers, and medium type homogenizers such as sand grinders, Getman mill, diamond fine mills and the like. Further, listed as surface active agents may be the same as those previously described.

Further, colorants (particles) may be subjected to surface modification. The surface modification method is as follows. Colorants are dispersed into a solvent, and surface modifiers are added to the resulting dispersion. Subsequently the resulting mixture is heated so as to undergo reaction. After completing said reaction, colorants are collected by filtration and repeatedly washed with the same solvent. Subsequently, the washed colorants are dried to obtain the colorants (pigments) which are treated with said surface modifiers.

The salting-out/fusion process is accomplished as follows. Salting-out agents, comprised of alkaline metal salts and/or alkaline earth metal salts and the like, are added to water comprising resinous particles as well as colorant particles as the coagulant at a concentration of higher than critical aggregation concentration. Subsequently, the resulting aggregation is heated above the glass transition point of said resinous particles so that fusion is carried out while simultaneously conducting salting-out. During this process, organic solvents, which are infinitely soluble in water, may be added.

Herein, listed as alkali metals and alkali earth metals, employed as salting-out agents, are, as alkali metals, lithium, potassium, sodium, and the like, and as alkali earth metals, magnesium, calcium, strontium, barium, and the like. Further, listed as those forming salts are chlorides, bromides, iodides, carbonates, sulfates, and the like.

Further, listed as said organic solvents, which are infinitely soluble in water, are alcohols such as methanol, ethanol, 1-propanol, 2-propanol, ethylene glycol, glycerin, acetone, and the like. Of these, preferred are methanol, ethanol, 1-propanol, and 2-propanol which are alcohols having not more than 3 carbon atoms.

In the salting-out/fusion process, it is preferable that hold-over time after the addition of salting-out agents is as short as possible. Namely it is preferable that after the addition of salting-out agents, a dispersion comprised of resinous particles and colorant particles is heated as soon as possible and heated to a temperature higher than the glass transition point of said resinous particles.

The reason for this is not well understood. However, problems occur in which the aggregation state of particles varies depending on the hold-over time after salting out so that the particle diameter distribution becomes unstable and surface properties of fused toner particles fluctuate.

Time before initiating heating (hold-over time) is commonly not more than 30 minutes, and is preferably not more than 10 minutes.

Temperatures, at which salting-out agents are added, are not particularly limited, and are preferably no higher than the glass transition temperature of resinous particles.

Further, it is required that in the salting-out/fusion process, the temperature is quickly increased by heating. The rate of temperature increase is preferably no less than 1° C./minute. The maximum rate of temperature increase is not particularly limited. However, from the viewpoint of minimizing the formation of coarse grains due to rapid salting-out/fusion, said rate is preferably not more than 15° C./minute.

Further, after the dispersion comprised of resinous particles and colorant particles is heated to a higher temperature than said glass transition point, it is important to continue the salting-out/fusion by maintaining the temperature of said dispersion for a specified period of time. By so doing, it is possible to effectively proceed with the growth of toner particles (aggregation of resinous particles as well as colorant particles) and fusion (disappearance of the interface between particles. As a result, it is possible to enhance the durability of the finally obtained toner.

Further, after terminating the growth of coalesced particles, fusion by heating may be continued.

(Filtration and Washing)

In said filtration and washing process, carried out is filtration in which toner particles are collected from the toner particle dispersion obtained by the process previously described, and adhered materials such as surface active agents, salting-out agents, and the like, are removed from the collected toner particles (a caked aggregation).

Herein, the filtration methods are not particularly limited, and include a centrifugal separation method, a vacuum filtration method which is carried out employing glass filter and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably be employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to pulverization treatment. Herein, employed as pulverization devices may be mechanical pulverization devices such as a jet mill, a Henschel mixer, a coffee mill, a food processor, and the like.

(Addition Process of External Additives)

This process is one in which external additives are added to dried toner particles.

Listed as devices which are employed for the addition of external additives, may be various types of mixing devices known in the art, such as tubular mixers, Henschel mixers, Nauter mixers, V-type mixers, and the like.

Herein, the toner particle diameter of the present invention is 3 to 9 $\mu$m in terms of the volume average particle diameter. It is possible to determine said volume average particle diameter of toner particles, employing a Coulter Counter TA-II, a Coulter Multisizer, SLAD 1100 (a laser diffraction type particle diameter measuring apparatus, produced by Shimadzu Seisakusho), and the like. Herein values are shown which are obtained based on the particle diameter distribution in the range of 2.0 to 40 $\mu$m, employing an aperture having an aperture diameter of 100 $\mu$m of said Coulter Counter TA-II as well as said Coulter Multisizer.

Further, the toner of the present invention is preferred in which the amount of minute toner powder having a diameter of not more than 2.0 μm is not more than 20 percent by number with respect to the total in term of the number distribution, and is more preferred in which the amount of minute toner powder particles having a diameter of not more than 2.0 μm is not more than 10 percent by number. It is possible to determine the amount of said minute toner powder particles employing a electrophoresis light scattering photometer ELS-800, produced by Otsuka Denshi Co. In order to adjust the particle diameter distribution to said range, the temperature during the salting-out/fusion stage, is preferably controlled in the narrow range. Specifically, the temperature is quickly increased, that is, the temperature increase rate is enhanced. These conditions have been described previously. The time to increase the temperature to said specified value is generally less than 30 minutes, and is preferably less than 10 minutes, and the temperature increase rate is preferably 1 to 15° C./minute.

Further, as the toner shape of the present invention, an average value (an average circularity) of the shape coefficient (circularity) described by the formula shown below is preferably 0.930 to 0.980, and is more preferably 0.940 to 0.975.

Shape coefficient=(circumferential length of a circle obtained based on the diameter equivalent to a circle)/(circumferential length of the projected toner image)

By adjusting said average circularity to the range of 0.930 to 0.980, it is possible to make the toner shape undefined and to make heat transfer more efficient so that fixability can be further improved. Namely, by adjusting the average circularity to not more than 0.980, it is possible to enhance fixability. Further by adjusting the average circularity to at least 0.930, the degree of undefined particle shape is controlled so that pulverization properties of particles due to stress during extended use can be retarded.

Further, the shape coefficient preferably has a narrow distribution, and the standard deviation of the circularity is preferably not more than 0.10. The CV value obtained by the formula shown below is preferably less than 20 percent, and is more preferably less than 10 percent.

CV value=(standard deviation of circularity/average circularity)×100

By adjusting the standard deviation of the circularity to not more than 0.10, it is possible to prepare toner particles having a uniform shape and to minimize the difference in fixability between toner particles. As a result, an increase in the fixing ratio as well as effects to minimize staining of the fixing unit is further exhibited. Further, by adjusting the CV value to less than 20 percent, it is possible to narrow the size distribution in the same manner and to more markedly exhibit fixability enhancing effects.

Methods for measuring said shape coefficient are not limited. For example, toner particles are enlarged by a factor of 500 employing an electron microscope and photographed. Subsequently, the circularity of at least 500 toner particles is determined, employing an image analysis apparatus. The arithmetic average is then obtained so that an average circularity can be calculated. Further, as a simple measurement method, it is possible to conduct measurement, employing FPIA-1000 (produced by Toa Iyodenshi Co., Ltd.).

Besides colorants and releasing agents, materials, which provide various functions as toner materials may be incorporated into the toner of the present invention. Specifically, charge control agents are cited. Said agents may be added employing various methods such as one in which during the salting-out/fusion stage, said charge control agents are simultaneously added to resinous particles as well as colorant particles so as to be incorporated into the toner, another is one in which said charge control agents are added to resinous particles, and the like.

In the same manner, it is possible to employ various charge control agents known in the art, which can be dispersed in water. Specifically listed are nigrosine based dyes, metal salts of naphthenic acid or higher fatty acids, alkoxyamines, quaternary ammonium salts, azo based metal complexes, salicylic acid metal salts or metal complexes thereof.

The toner of the present invention is suitably employed to form semi-gloss images.

The "semi-gloss images", as described herein, refer to images having a standard glossiness of 17 to 37. The standard glossiness, as described in the present invention, is represented by a value determined in such a manner that an image area, in which an image forming material (toner) covers at least 90 percent of the image forming support, is measured at an incident angle of 75 degrees, employing a gloss meter VGS-1D (produced by Nihon Denshoku Kogyo Co., Ltd.) in accordance with JIS-Z8741-1983. The covering ratio of said image forming material on said image forming material was determined employing a high speed color image analysis apparatus SPICCA (produced by Nihon Avionics Co.).

In the present invention, the standard glossiness of the semi-gloss images is 17 to 37, and is preferably to be 17 to 27. When the standard glossiness is less than 17, images lack brightness and sufficient sensation of quality is not obtained. On the other hand, when the standard glossiness exceeds 37, reflection light from the front surface becomes excessive, and sufficient sensation of quality is not obtained, as well as realism is insufficient. Further, when the surface is smooth, the amount of incident light into the interior becomes greater, and colorants tend to be degraded and image degradation develops during storage. In order to minimize the degradation of colorants, it is specifically preferable that the standard glossiness be not more than 27.

<Developers>

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. Said toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle size distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

EXAMPLES

The present inventing will now be detailed with reference to examples. Incidentally, "parts" in the following description is parts by weight, unless otherwise specified.

Preparation Example 1

Placed into a 5,000 ml separable flask fitted with a stirring unit, a temperature sensor, a cooling pipe, and a nitrogen gas inlet was a surface active agent solution (water based medium) prepared by dissolving 7.08 g of an anionic surface active agent (sodium dodecylbenzenesulfonate: SDS) in 2,760 g of deionized water, and the interior temperature was raised to 80° C. under a nitrogen gas flow while stirring at 230 rpm.

A monomer solution was prepared by adding 72.0 g of the compound, represented by the aforementioned formula 20) (hereinafter referred to as "Exemplified Compound (20)") to a mixed monomer solution consisting of 115.1 g of styrene, 42.0 g of n-butyl acrylate, and 10.9 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 7.73 g of said polymerization initiator (KPS) in 240 ml of deionized water was added to the resulting latex. After 15 minutes, a monomer mixture solution consisting of 383.6 g of styrene, 140.0 g of n-butyl acrylate, 36.4 g of methacrylic acid, and 13.7 g of t-dodecylmercaptan was added dropwise over 126 minutes. After said dropwise addition, the resulting mixture underwent polymerization (a second stage polymerization) while stirring for 60 minutes, and then cooled to 40° C. Thus latex (a dispersion comprised of core shell structure resinous particles having releasing agents in the core) was obtained. The resulting latex was designated as "Latex (1)".

Preparation Example 2

Latex (a dispersion comprised of core shell structure resinous particles having releasing agents in their core) was obtained in the same manner as Preparation Example 1, except that the added amount of Exemplified Compound (20) was varied to 60.0 g. The resulting latex was designated as "Latex (2)".

Preparation Example 3

Latex (a dispersion comprised of core shell structure resinous particles having releasing agents in the core) was obtained in the same manner as Preparation Example 1, except that the added amount of Exemplified Compound (20) was changed to 96.0 g. The resulting latex was designated as "Latex (3)".

Preparation Example 4

Latex (a dispersion comprised of core shell structure resinous particles having releasing agents in the core) was obtained in the same manner as Preparation Example 1, except that the added amount of Exemplified Compound (20) was changed to 120.0 g and the resulting latex was designated as "Latex (4)".

Preparation Example 5

Latex (a dispersion comprised of core shell structure resinous particles having releasing agents in the core) was obtained in the same manner as Preparation Example 1, except that Exemplified Compound (20) was replaced with 72.0 g of the compound represented by the aforementioned formula 19) (hereinafter referred to as "Exemplified Compound (19)") and the resulting latex was designated as "Latex (5)".

Preparation Example 6

Latex (a dispersion comprised of core shell structure resinous particles having releasing agents in the core) was obtained in the same manner as Preparation Example 1, except that Exemplified Compound (20) was replaced with 72.0 g of the compound represented by the aforementioned formula 18) (hereinafter referred to as "Exemplified Compound (18)"), whereupon the resulting latex was designated as "Latex (6)".

Preparation Example 7

Latex (a dispersion comprised of core shell structure resinous particles having releasing agents in the core) was obtained in the same manner as Preparation Example 1, except that Exemplified Compound (20) was replaced with 120.0 g of the compound represented by the aforementioned formula 8) (hereinafter referred to as "Exemplified Compound (8)"), whereupon the resulting latex was designated as "Latex (7)".

Preparation Example 8

Latex (a dispersion comprised of core shell structure resinous particles having releasing agents in the core) was obtained in the same manner as Preparation Example 2, except that the added amount of potassium persulfate, which was added to perform the first stage polymerization (synthesis of high molecular weight components), was changed to 0.42 g, and the resulting latex was designated as "Latex (8)".

Preparation Example 9

Latex (a dispersion comprised of core shell structure resinous particles having releasing agents in the core) was obtained in the same manner as Preparation Example 2, except that the added amount of potassium persulfate, which was added to perform the second stage polymerization (synthesis of low molecular weight components), was changed to 9.276 g, whereupon the resulting latex was designated as "Latex (9)".

Preparation Example 10

Latex (a dispersion comprised of core shell structure resinous particles having releasing agents in the core) was obtained in the same manner as Preparation Example 2, except that the added amount of t-dodecylmercaptan (chain transfer agent), which was added to perform the second stage polymerization (synthesis of low molecular weight components), was changed to 16.44 g. The resulting latex was designated as "Latex (10)".

Preparation Example 11

Placed into a 5,000 ml separable flask fitted with a stirring unit and a temperature sensor, a cooling unit, and nitrogen gas inlet unit was a surface active agent solution (water based medium) prepared by dissolving 8.4 g of an anionic surface active agent (sodium dodecylbenzenesulfonate: SDS) in 2,760 g of deionized water, and the interior temperature was raised to 80° C. under a nitrogen gas flow while stirring at 230 rpm.

A monomer solution was prepared by adding 86.4 g of Exemplified Compound (20) to a monomer mixture solution consisting of 138.1 g of styrene, 50.4 g of n-butyl acrylate, and 13.1 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.84 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 6.0 g of said polymerization initiator (KPS) in 240 ml of deionized water was added to the resulting latex. After 15 minutes, a monomer mixture solution consisting of 306.9 g of styrene, 112.0 g of n-butyl acrylate, 29.12 g of methacrylic acid, and 10.96 g of t-dodecylmercaptan was added dropwise over 120 minutes. After the dropwise addition, the resulting mixture underwent polymerization (a second stage polymerization) while stirring for 60 minutes, and then cooled to 40° C. Thus latex (a dispersion comprised of core shell structure resinous particles having releasing agents in the core) was obtained. The resulting latex was designated as "Latex (11)".

Preparation Example 12

Placed into a 5,000 ml separable flask, fitted with a stirring unit and a temperature sensor, a cooling pipe, and nitrogen gas inlet unit, was a surface active agent solution (water based medium) prepared by dissolving 5.6 g of an anionic surface active agent (sodium dodecylbenzenesulfonate: SDS) in 2,760 g of deionized water, and the interior temperature was raised to 80° C. under a nitrogen gas flow while stirring at 230 rpm.

A monomer solution was prepared by adding 75.6 g of Exemplified Compound (20) to a monomer mixture solution consisting of 92.1 g of styrene, 33.6 g of n-butyl acrylate, and 8.7 g of methacrylic acid followed by being dissolved while heated to 80° C.

Said monomer solution (at 80° C.) was mixed with and dispersed into said surface active agent solution employing a mechanical type homogenizer, having a circulation channel, and a dispersion comprised of emulsion particles (oil droplets), having a uniform dispersed particle diameter, was prepared.

Subsequently, a solution prepared by dissolving 0.6 g of a polymerization initiator (potassium persulfate: KPS) in 200 g of deionized water was added to the resulting dispersion, and the resulting mixture underwent polymerization (a fist stage polymerization) while being heated to 80° C. and stirred for 3 hours, whereby latex was prepared.

Subsequently, a solution prepared by dissolving 9.1 g of said polymerization initiator (KPS) in 240 ml of deionized water was added to the resulting latex. After 15 minutes, a monomer mixture solution consisting of 498.7 g of styrene, 182.0 g of n-butyl acrylate, 47.3 g of methacrylic acid, and 17.8 g of t-dodecylmercaptan was added dropwise over 120 minutes. After the dropwise addition, the resulting mixture underwent polymerization (a second stage polymerization) while stirring for 60 minutes, and then cooled to 40° C. Thus, latex (a dispersion comprised of core shell structure resinous particles having releasing agents in the core) was obtained, and the resulting latex was designated as "Latex (12)".

Production Example 1

(Production of Toner)

Added to 160 ml of deionized water were 9.2 g of sodium n-dodecylsulfate which were stirred and dissolved. While stirring the resulting solution, 20 g of carbon black, "Regal 330R" (produced by Cabot Corp.), were gradually added, and subsequently dispersed employing a stirring unit, "Clearmix" (produced by M Technique Ltd.) equipped with a high speed rotating rotor. Thus a colorant particle dispersion (hereinafter referred to as "Colorant Dispersion (1)") was prepared. The colorant particle diameter of said Colorant Dispersion (1) was determined employing an electrophoresis light scattering photometer "ELS-800" (produced by Ohtsuka Denshi Co.), resulting in a weight average particle diameter measurement of 112 nm.

Placed into a 5-liter four-necked flask fitted with a temperature sensor, a cooling pipe, a nitrogen gas inlet unit, and a stirring unit were 1250 g of Latex (1) obtained in Preparation Example 1, 2000 ml of deionized water, and Colorant Dispersion (1) prepared as previously described, and the resulting mixture was stirred. After adjusting the interior temperature to 30° C., 5N aqueous sodium hydroxide solution was added to the resulting solution, and the pH was adjusted to 10.0. Subsequently, an aqueous solution prepared by dissolving 52.6 g of magnesium chloride tetrahydrate in 72 ml of deionized water was added at 30° C. over 10 minutes. After setting the resulting mixture aside for 3 minutes, it was heated so that the temperature was increased to 90° C. within 6 minutes (at a temperature increase rate of 10° C./minute). While maintaining the resulting state, the diameter of coalesced particles was measured employing a "Coulter Counter TA-II". When the volume average particle diameter reached 6.5 $\mu$m, the growth of particles was terminated by the addition of an aqueous solution prepared by dissolving 115 g of sodium chloride in 700 ml of deionized water, and further fusion was continually carried out at a liquid media temperature of 90±2° C. for 6 hours, while being heated and stirred. Thereafter, the temperature was decreased to 30° C. at a rate of 6° C./minute. Subsequently, the pH was adjusted to 2.0, and stirring was terminated. The resulting coalesced particles were collected through filtration, and repeatedly washed with deionized water. Washed particles were then dried by 40° C. air, and thus colored particles were obtained. The colored particles obtained as previously described were designated as "Colored Particles 1".

Production Examples 2 through 12

Colored particles were obtained in the same manner as Production Example 1, except that in accordance with formulas of Table 1, shown below, the types of latexes were varied and in Production Examples 7, 8, and 12, the types of carbon black utilized as colorants were further varied. Colored particles obtained as previously described were designated as "Colored Particles 2 through 12".

Comparative Production Example 1

(Production of Suspension Polymerization Toner) Placed into a four-necked flask fitted with a high speed stirring unit (TK Homomixer) were 710 parts of deionized water and 450 parts of 0.1 mole/liter aqueous trisodium phosphate. The resulting mixture was heated to 65° C., and 68 parts of 1.0 mole/liter aqueous calcium chloride solution were gradually added at a stirring rate of 12,000 rpm, whereby a water based medium comprised of a dispersion containing colloidal trisodium phosphate was prepared.

Alternatively, a dispersion was prepared by blending 14 parts of carbon black, "Regal 330R", (produced by Cabot Corp.) with a monomer mixture solution consisting of 165 parts of styrene and 35 parts of n-butyl acrylate, and dispersing the resulting mixture employing a sand grinder. Thereafter, 60 parts of Exemplified Compound (20) were added to the resulting dispersion and dissolved at 80° C. Subsequently, 10 parts of 2,2'-azobis(2,4-dimethylvaleronitrile) as the polymerization initiator were added to the resulting mixture, whereby a monomer composition was prepared.

Said monomer composition prepared as previously described was gradually added to and dispersed in said water based medium at a stirring rate of 12,000 rpm. Subsequently, the resulting dispersion underwent polymerization under a nitrogen gas flow at 65° C. for 10 hours at a stirring rate of 200 rpm, employing said TK Homomixer in which a special stirring blade had been replaced with an ordinary one. When the polymerization reaction was completed, hydrochloric acid was added and tricalcium phosphate, which acted as a dispersion stabilizer, was removed. Subsequently, comparative colored particles were obtained through filtration, washing, and drying. The colored particles obtained as above were designated as "Comparative Colored Particles 1".

Comparative Production Example 2

(Toner Production Employing the Kneading and Pulverization Method)

One hundred parts of styrene-acryl resin, 10 parts of carbon black "Regal 330R" (produced by Cabot Corp.), and 10 parts of Exemplified Compound (20) were blended employing a Henschel mixer. Thereafter, the resulting mixture was melt kneaded employing a biaxial extruder, and subsequently pulverized employing a mechanical pulverizer, and classified employing an air classifier to obtain comparative colored particles. Colored particles obtained as above were designated as "Comparative Colored Particles 2".

With each of the kinds of colored particles obtained as above (Colored Particles 1 through 12 and Comparative Colored Particles 1 and 2), determined were the average of circularity (average circularity), the standard deviation of circularity, CV values of circularity, the volume average particle diameter, the peak molecular weight of high molecular weight components, the peak molecular weight of low molecular weight components, and the molecular weights (number average molecular weight and weight average molecular weight). Table 1 shows all the results.

TABLE 1

| Colored Particles | Latex | Colorant | Average Circularity | Standard Deviation of Circularity |
|---|---|---|---|---|
| Colored Particles 1 | Latex 1 | Regal 330R | 0.963 | 0.031 |
| Colored Particles 2 | Latex 2 | Regal 330R | 0.966 | 0.036 |
| Colored Particles 3 | Latex 3 | Regal 330R | 0.963 | 0.045 |
| Colored Particles 4 | Latex 4 | Regal 330R | 0.972 | 0.051 |
| Colored Particles 5 | Latex 5 | Regal 330R | 0.970 | 0.034 |
| Colored Particles 6 | Latex 6 | Regal 330R | 0.956 | 0.031 |
| Colored Particles 7 | Latex 7 | Regal L | 0.969 | 0.035 |
| Colored Particles 8 | Latex 8 | Regal L | 0.956 | 0.032 |
| Colored Particles 9 | Latex 9 | Regal 330R | 0.972 | 0.038 |
| Colored Particles 10 | Latex 10 | Regal 330R | 0.965 | 0.032 |
| Colored Particles 11 | Latex 11 | Regal 330R | 0.963 | 0.030 |
| Colored Particles 12 | Latex 12 | Regal L | 0.966 | 0.031 |
| Comparative Colored Particles 1 | — | Regal 330R | 0.981 | 0.038 |
| Comparative Colored Particles 2 | — | Regal 330R | 0.936 | 0.112 |

TABLE 1-continued

| Colored Particles | CV Value of Circularity | Volume Average Particle Diameter (in μm) | Peak Molecular Weight: High Molecular Weight Components | Peak Molecular Weight: Low Molecular Weight Components | Molecular Weight of Resin: Number Average Molecular Weight | Molecular Weight of Resin: Weight Average Molecular Weight |
|---|---|---|---|---|---|---|
| Colored Particles 1 | 3.2 | 6.7 | 242,000 | 19,000 | 5,900 | 43,000 |
| Colored Particles 2 | 3.7 | 6.6 | 242,000 | 19,000 | 5,900 | 43,000 |
| Colored Particles 3 | 4.7 | 6.7 | 242,000 | 19,000 | 5,900 | 43,000 |
| Colored Particles 4 | 5.2 | 6.9 | 242,000 | 19,000 | 5,900 | 43,000 |
| Colored Particles 5 | 3.5 | 6.3 | 242,000 | 19,000 | 5,900 | 43,000 |
| Colored Particles 6 | 3.2 | 6.8 | 242,000 | 19,000 | 5,900 | 43,000 |
| Colored Particles 7 | 3.6 | 7.2 | 242,000 | 19,000 | 6,300 | 56,000 |
| Colored Particles 8 | 3.3 | 6.3 | 369,000 | 19,000 | 7,200 | 69,000 |
| Colored Particles 9 | 3.9 | 6.9 | 242,000 | 12,000 | 4,200 | 42,000 |
| Colored Particles 10 | 3.3 | 6.8 | 242,000 | 19,000 | 4,300 | 42,000 |
| Colored Particles 11 | 3.1 | 6.2 | 242,000 | 19,000 | 6,500 | 72,000 |
| Colored Particles 12 | 3.2 | 6.2 | 242,000 | 19,000 | 4,200 | 39,000 |
| Comparative Colored Particles 1 | 3.9 | 6.3 | 114,000 | — | 14,500 | 61,000 |
| Comparative Colored Particles 2 | 12.0 | 6.3 | 234,000 | 16,000 | 5,800 | 43,000 |

(* "Circularity" described above was determined under conditions of an analyzed sample amount of 0.3 μl and the number of detected particles of 1,5000 to 5,000, employing an FPIA-1000 (produced by Toa Iyodenshi Co.))

Hydrophobic silica (having a number average primary particle diameter of 12 nm, as well as a degree of hydrophobicity of 68) and hydrophobic titanium (having a number average primary particle diameter of 20 nm, as well as a degree of hydrophobicity of 63) were added to each of Colored Particles 1 through 12, and Comparative Colored Particles 1 and 2, so as to result in a ratio of 1.0 percent by weight and 1.2 percent by weight, respectively. The resulting mixtures were blended, employing a Henschel mixer, whereby a toner was obtained. The resulting toners were designated as Toners 1 through 12 and Comparative Toner 1 and 2, corresponding to Colored Particles 1 through 12, and Comparative Colored Particles 1 and 2. No differences were found among the colored particles and among the resulting toners with respect to the shape, the particle diameter, and the like.

Each of Toners 1 through 12, and Comparative Toners 1 and 2 was blended with a silicone coated ferrite carrier having a volume average particle diameter of 60 μm, so as to result in a toner concentration of 6 percent by weight. Thus, developers were prepared. The resulting developers were designated as Developers 1 through 12, and Comparative Developers 1 and 2, corresponding to Toners 1 through 12, and Comparative Toners 1 and 2.

(Preparation of Fixing Unit)

Pressure contact system fixing units (Fixing Units 1 through 13), as shown in FIG. 1, were prepared.

(Fixing Unit 1)

A heating roller (an upper roller) was prepared by covering the surface of an aluminum alloy cylinder (having an interior diameter of 40 mm, a wall thickness of 1.0 mm, and a total length of 310 mm), incorporating a heater into its center, with a tube (having a thickness of 120 μm) comprised of a tetrafluoroethylene-perfluoroalkyl vinyl ether copolymer (PFA). On the other hand, a pressure roller (a lower roller) was prepared by covering the surface of an iron cylinder (having an interior diameter of 40 mm and a wall thickness of 2.0 mm) with a sponge-like silicone rubber (having an Asker hardness of 48 and a thickness of 2 mm). Said heating roller was brought into contact with said pressure roller under an application of total load of 150 N to form a nip having a width of 5.8 mm. Employing said fixing unit, the linear speed for printing was set at 150 mm/second. Further, employed as a cleaning mechanism was a supply method of a web system impregnated with polydiphenylsilicone (having a viscosity of 10 Pa·s at 20° C.). Fixing temperature was controlled by the surface temperature of said heating roller. Further, the coating amount of said silicone oil was adjusted to 0.6 mg/A4. This was designated as "Fixing Unit 1".

(Fixing Units 2 through 13)

Based on Table 2 below, Fixing Units 2 through 13 were prepared in which at least one condition of the surface covering layer configuration of the heating roller (types of fluorine resins, covering methods, and thickness), the surface covering layer configuration of the pressure roller (Asker C hardness of silicone rubber and thickness), contact load (total load), nip width, viscosity of silicone oil (at 20° C.), and the supply amount was varied from that of Fixing Unit 1.

TABLE 2

| | Surface Covering Layer of Heating Roller | | | Surface Covering Layer of Pressure Roller | |
|---|---|---|---|---|---|
| | Type of Fluorine Resin | Covering Method | Thickness (in μm) | Asker C Hardness | Thickness (in mm) |
| Fixing Unit 1 | PFA | tube | 120 | 48 | 2 |
| Fixing Unit 2 | PFA | tube | 120 | 40 | 2 |
| Fixing Unit 3 | PFA | tube | 50 | 52 | 2 |
| Fixing Unit 4 | PFA | tube | 350 | 55 | 1 |
| Fixing Unit 5 | PFA | tube | 350 | 55 | 1 |
| Fixing Unit 6 | PFA | tube | 120 | 30 | 5 |
| Fixing Unit 7 | PTFE | tube | 120 | 48 | 0.5 |
| Fixing Unit 8 | PTFE | coating | 120 | 33 | 2 |
| Fixing Unit 9 | PFA | coating | 120 | 79 | 2 |
| Fixing Unit 10 | PFA | tube | 120 | 48 | 0.1 |
| Fixing Unit 11 | PFA | tube | 120 | 48 | 2 |
| Fixing Unit 12 | PFA | coating | 5 | 48 | 2 |
| Fixing Unit 13 | PFA | tube | 600 | 48 | 2 |

| | Total Load (in N) | Nip Width (in mm) | Silicone Oil Viscosity at 20° C. (in Pa · s) | Silicone Oil Supply Amount (in mg/A4) |
|---|---|---|---|---|
| Fixing Unit 1 | 150 | 5.8 | 10 | 0.6 |
| Fixing Unit 2 | 200 | 6.8 | 10 | 0.6 |
| Fixing Unit 3 | 180 | 5.5 | 10 | 1.6 |
| Fixing Unit 4 | 150 | 5.2 | 10 | 0.3 |
| Fixing Unit 5 | 150 | 5.2 | — | 0 |
| Fixing Unit 6 | 150 | 6.6 | 10 | 1.8 |
| Fixing Unit 7 | 250 | 3.2 | 20 | 0.6 |
| Fixing Unit 8 | 250 | 6.6 | 20 | 0.6 |
| Fixing Unit 9 | 250 | 2.2 | 20 | 0.6 |
| Fixing Unit 10 | 250 | 2.6 | 10 | 0.6 |
| Fixing Unit 11 | 150 | 5.6 | 10 | 3.0 |
| Fixing Unit 12 | 150 | 5.6 | 10 | 0.6 |
| Fixing Unit 13 | 150 | 5.6 | 10 | 0.6 |

Examples 1 through 22 and Comparative Examples 1 through 4

Copies were practically produced employing a "Konica 7060", a digital copier, in which, based on the combinations shown in Table 3 below, each of Developers 1 through 12, and Comparative Developers 1 and 2, and each of Fixing Units 1 through 13 were provided. Then fixability (fixing ratio of halftone) as well as offsetting resistance (back staining and surface staining) was evaluated. Incidentally, the surface temperature of the heating roller in the fixing unit was set at 175° C. at the center. Development conditions as well as evaluation methods are as follows.

(Development Conditions)

Photoreceptor: lamination type organic photoreceptor

DC bias: −500 V

Dsd (distance between the photoreceptor and the development sleeve): 600 μm

Developer layer regulation: magnetic H-Cut system

Developer layer thickness: 700 μm

Development sleeve diameter: 40 mm (Evaluating Methods)

(1) Fixability

Halftone images (having a relative reflection density of 1.0 when the density of a normal paper sheet is 0) were printed and the fixing ratio was determined.

The fixing ratio was obtained as follows. A fixed image was rubbed employing 1 kg weight, wrapped in bleached cotton cloth, and image density before and after rubbing was measured. Then, the fixing ratio was determined employing the formula described below. Table 4 below shows the results.

$$\text{Fixing ratio (in percent)}=[\text{image density after rubbing}]/(\text{image density before rubbing})]\times 100$$

(2) Back Staining and Surface Staining

After continually copying a line image (having a pixel ratio of 15 percent) onto 5,000 sheets in the A4 transverse conveying direction, two solid white images were copied in the A4 longitudinal conveying direction (this was designated as one cycle), and a total of 10 cycles were performed. Further, after every cycle, said copier was suspended overnight.

At the completion of one cycle, the presence and absence of staining and the magnitude of staining on the surface of said solid white image, as well as the presence and absence of staining and the magnitude of staining on the back (back staining) of the formed image at the initiation of said cycle (the first sheet after the rest) were visually evaluated. The resulting staining was ranked A through C, based on the criteria described below.

Table 4 below shows the number of cycles which reached Rank C (generation frequency of Rank C) and the staining rank at the completion of 10 cycles (staining rank after 10 operations).

Rank A: no staining results

Rank B: slight staining results which are still commercially viable

Rank C: staining is visually noticed, which results in a commercially unviable product

TABLE 3

| | Developer | Fixing Unit |
|---|---|---|
| Example 1 | Developer 1 | Fixing Unit 1 |
| Example 2 | Developer 2 | Fixing Unit 1 |
| Example 3 | Developer 3 | Fixing Unit 1 |
| Example 4 | Developer 4 | Fixing Unit 1 |
| Example 5 | Developer 5 | Fixing Unit 1 |
| Example 6 | Developer 6 | Fixing Unit 1 |
| Example 7 | Developer 7 | Fixing Unit 1 |
| Example 8 | Developer 8 | Fixing Unit 1 |
| Example 9 | Developer 9 | Fixing Unit 1 |
| Example 10 | Developer 10 | Fixing Unit 1 |
| Example 11 | Developer 11 | Fixing Unit 1 |
| Example 12 | Developer 12 | Fixing Unit 1 |
| Example 13 | Developer 1 | Fixing Unit 2 |
| Example 14 | Developer 1 | Fixing Unit 3 |
| Example 15 | Developer 1 | Fixing Unit 4 |
| Example 16 | Developer 1 | Fixing Unit 5 |
| Example 17 | Developer 1 | Fixing Unit 6 |
| Example 18 | Developer 1 | Fixing Unit 7 |
| Example 19 | Developer 1 | Fixing Unit 8 |
| Example 20 | Developer 1 | Fixing Unit 9 |
| Example 21 | Developer 1 | Fixing Unit 10 |
| Example 22 | Developer 1 | Fixing Unit 11 |
| Comparative Example 1 | Developer 1 | Fixing Unit 12 |
| Comparative Example 2 | Developer 1 | Fixing Unit 13 |

TABLE 3-continued

| | | | |
|---|---|---|---|
| Comparative Example 3 | Comparative Developer 1 | Fixing Unit 1 | |
| Comparative Example 4 | Comparative Developer 2 | Fixing Unit 1 | |

| | | Back Staining | | Surface Staining | |
|---|---|---|---|---|---|
| | Fixing Ratio | Frequency of Rank C Formation | 10th Staining Rank | Frequency of Rank C Formation | 10th Staining Rank |
| Example 1 | 97% | — | Rank A | — | Rank A |
| Example 2 | 96% | — | Rank A | — | Rank A |
| Example 3 | 97% | — | Rank A | — | Rank A |
| Example 4 | 97% | — | Rank A | — | Rank A |
| Example 5 | 95% | — | Rank A | — | Rank A |
| Example 6 | 95% | — | Rank A | — | Rank A |
| Example 7 | 96% | — | Rank A | — | Rank A |
| Example 8 | 94% | — | Rank A | — | Rank A |
| Example 9 | 98% | — | Rank B | — | Rank A |
| Example 10 | 97% | — | Rank A | — | Rank A |
| Example 11 | 91% | — | Rank A | — | Rank A |
| Example 12 | 97% | — | Rank B | — | Rank A |
| Example 13 | 92% | — | Rank A | — | Rank A |
| Example 14 | 96% | — | Rank A | — | Rank A |
| Example 15 | 95% | — | Rank B | — | Rank A |
| Example 16 | 95% | | Rank B | | Rank B |
| Example 17 | 97% | — | Rank A | — | Rank A |
| Example 18 | 91% | — | Rank A | — | Rank A |
| Example 19 | 97% | — | Rank A | — | Rank A |
| Example 20 | 94% | — | Rank A | — | Rank A |
| Example 21 | 95% | — | Rank A | — | Rank A |
| Example 22 | 96% | — | Rank A | — | Rank A |
| Comparative Example 1 | 75% | 6th | Rank C | 6th | Rank C |
| Comparative Example 1 | 73% | 7th | Rank C | 7th | Rank C |
| Comparative Example 1 | 82% | 8th | Rank C | 8th | Rank C |
| Comparative Example 1 | 83% | 8th | Rank C | 8th | Rank C |

As can clearly be seen from the results shown in Table 4, by employing the image forming methods (Examples 1 through 22) comprising the fixing process in which the toner of the present invention, as well as the specified fixing unit, is employed, it is possible to form excellent images with minimized image staining, as well as reduced image problems over an extended period of time. Contrary to this, image forming methods (Comparative Examples 1 and 2) which did not employ the specified fixing unit, as well as those (Comparative Examples 3 and 4) which did not use the toner of the present invention, resulted in inferior fixability as well as inferior offsetting resistance, causing problems under practical usage.

When the toner of the present invention is employed in an image forming method comprising an image forming process in which fixed images are formed, even employing a fixing unit supplied with no silicone oil or a very small amount of silicone oil, it is possible to form images with minimized image staining as well as reduced image problems for an extended period of time, and to markedly extend the working life of said fixing unit.

When the image forming method of the present invention is employed, even in cases in which fixed images are formed employing a fixing unit supplied with no silicone oil or a very small amount of silicone oil, it is possible to form images with minimized image staining as well as reduced image problems for an extended period of time, and to markedly extend the working life of said fixing unit.

What is claimed is:

1. An image forming method comprising developing an electrostatic latent image formed on a photoreceptor to form a toner image employing a developer comprising a toner, transferring the toner image onto an image forming material, and fixing the transferred toner image onto the image forming material, employing a fixing unit wherein said fixing unit is downstream of said developer and, wherein the fixing unit comprises a heating roller and a pressure roller which is brought into contact with said heating roller wherein said transferred toner image is fixed onto the image forming material by passing said image forming material with said transferred toner image between said heating roller and said pressure roller.

the heating roller comprises a cylinder having an interior diameter of from 10 to 70 mm and a wall thickness of from 0.1 to 2 mm comprised of a metal or a metal alloy, and a heating member being incorporated in the interior, a surface of the cylinder being covered with a layer comprising a fluorine resin at a thickness of from 10 to 500 $\mu$m, the pressure roller comprises a metal cylinder covered with a covering layer comprising an elastic material having an Asker hardness C of less than 80 degrees at a thickness of 0.1 to 30 mm, and the toner comprises a binder resin, a colorant, and a releasing agent, and is obtained by salting out/fusing resin particles comprising the releasing agent in binding resin and colorant particles.

2. The image forming method of claim 1 wherein the fluorine resin is polytetrafluoroethylene or tertafluoroethylene-perfluoroalkyl vinyl ether copolymer.

3. The image forming method of claim 1 wherein the cylinder of the heating roller is composed of iron, aluminum, copper, or alloy thereof.

4. The image forming method of claim 1 wherein the elastic material is soft rubber or foamed rubber.

5. The image forming method of claim 4 wherein the elastic material is urethane rubber, silicone rubber, or silicone sponge rubber.

6. The image forming method of claim 5 wherein the elastic material is silicone rubber, or silicone sponge rubber.

7. The image forming method of claim 1 wherein the Asker C hardness of elastic material is less than 70 degrees.

8. The image forming method of claim 1 wherein the Asker C hardness of elastic material is less than 60 degrees.

9. The image forming method of claim 1 wherein the releasing agent is represented by Formula (1), $$R^1—(OCO—R^2)_n \qquad (1):$$

wherein $R^1$ and $R^2$ each represent a hydrocarbon group having from 1 to 40 carbon atoms which may have a substituent, and n represents an integer of 1 to 4.

10. The image forming method of claim 1 wherein silicone oil is supplied to the heating roller in amount of not more than 2 mg per A4 sized sheet of paper.

11. The image forming method of claim 1 wherein the thickness of the layer comprising the fluorine resin is 20 to 400 $\mu$m.

12. The image forming method of claim 1 wherein the thickness of the covering layer is 0.1 to 20 $\mu$m.

13. The image forming method of claim 1 wherein temperature of fixing is 150 to 210° C.

14. The image forming method of claim 1 wherein content ratio of releasing agents in the toner is 1 to 30 percent by weight.

15. The image forming method of claim 1 wherein the toner has an average value of the shape coefficient of 0.930 to 0.980.

16. The image forming method of claim 15 wherein the thickness of the layer comprising the fluorine resin is 20 to 400 $\mu$m, the thickness of the covering layer is 0.1 to 20 $\mu$m, temperature of fixing is 150 to 210° C., and content ratio of releasing agents in the toner is 1 to 30 percent by weight.

17. The image forming method of claim 16 wherein wherein the elastic material is urethane rubber, silicone rubber, or silicone sponge rubber, and the Asker C hardness of elastic material is less than 60 degrees.

18. An image forming apparatus comprising a developing unit comprising a toner, a photoreceptor, a transferring unit, and a fixing unit, wherein said transferring unit transfers a toner image onto image forming material and said fixing unit is downstream of said transferring unit the fixing unit comprises a heating roller and a pressure roller which is brought into contact with said heating roller, wherein said transferred toner image is fixed onto the image forming material by passing said image forming material with said transferred toner image between said heating roller and said pressure roller the heating roller comprises a cylinder having an interior diameter of from 10 to 70 mm and a wall thickness of from 0.1 to 2 mm comprised of a metal or a metal alloy, and a heating member being incorporated in the interior, a surface of the cylinder being covered with a layer comprising a fluorine resin at a thickness of from 10 to 500 $\mu$m, the pressure roller comprises a metal cylinder covered with a covering layer comprising an elastic material having an Asker hardness C of less than 80 degrees at a thickness of 0.1 to 30 mm, and the toner comprises a binder resin, a colorant, and a releasing agent, and is obtained by salting out/fusing resin particles comprising the releasing agent in binding resin and colorant particles.

* * * * *